US010056722B1

(12) United States Patent
Ingram

(10) Patent No.: US 10,056,722 B1
(45) Date of Patent: Aug. 21, 2018

(54) DEVICES AND METHODS FOR PROVIDING ELECTRICAL POWER

(71) Applicant: Jamal A Ingram, Windsor, CT (US)

(72) Inventor: Jamal A Ingram, Windsor, CT (US)

( * ) Notice: Subject to any disclaimer, the term of this patent is extended or adjusted under 35 U.S.C. 154(b) by 0 days.

(21) Appl. No.: 15/139,222

(22) Filed: Apr. 26, 2016

Related U.S. Application Data

(60) Provisional application No. 62/152,894, filed on Apr. 26, 2015.

(51) Int. Cl.
*H01R 25/00* (2006.01)

(52) U.S. Cl.
CPC ..... *H01R 25/00* (2013.01)

(58) Field of Classification Search
CPC .. H01R 31/06; H01R 31/065; H01R 13/6395; H01R 24/525; H01R 33/88
USPC ..... 439/650, 652, 535, 638, 653, 654
See application file for complete search history.

(56) References Cited

U.S. PATENT DOCUMENTS 5,035,630 A * 7/1991 Norsworthy ..... H02B 1/52 174/6
5,465,198 A 11/1995 Kellogg
5,971,808 A * 10/1999 Chiang ..... H01R 13/447 439/654
6,042,426 A 3/2000 Byrne
6,126,460 A 10/2000 Wu
6,135,820 A 10/2000 Chiang
6,165,010 A 12/2000 Prazoff
6,200,159 B1 3/2001 Chou
6,296,522 B1 10/2001 Ho
6,633,932 B1 10/2003 Bork
6,747,859 B2 * 6/2004 Walbeck ..... H01R 13/719 361/111
6,875,051 B2 4/2005 Pizak
(Continued)

FOREIGN PATENT DOCUMENTS

EP 2212756 8/2010

OTHER PUBLICATIONS

"6 Port Portable USB Hub Desktop Wall Charger Socket Adapter EU Plug Slots Charging Extension Socket Outlet With Switcher," AliExpress, aliexpress.com, seller: Toprated Mall, © 2015, accessed: Aug. 2015. http://www.aliexpress.com/item/6PortPortableUSBHubDesktopWallChargerACPowerAdapterEUPlugSlotsChargingExtension/32245428795.html.
(Continued)

*Primary Examiner* — Tulsidas C Patel
*Assistant Examiner* — Marcus Harcum
(74) *Attorney, Agent, or Firm* — Attentive Law

(57) ABSTRACT

Devices and methods are described to provide electrical power. A device of the invention may comprise a particular arrangement of components including (A) a plug assembly including positive and negative prongs, outwardly facing, for interfacing with a female cord end; (B) a first outlet assembly including positive and negative apertures, outwardly facing, for interfacing with a male cord end; and with the plug assembly and first outlet assembly disposed in an interior space of the device at a back of a housing of the device; (C) a second outlet assembly including at least one receptacle for interfacing with a male cord end, the second outlet assembly disposed in the interior space of the device and supported by the at least one vertical wall at a front of a housing of the device, the second outlet having a negative connection and a positive connection; and (D) a circuit breaker.

20 Claims, 12 Drawing Sheets

(56) References Cited

U.S. PATENT DOCUMENTS

| | | | | |
|---|---|---|---|---|
| 6,913,467 | B2 | 7/2005 | Huang | |
| 7,112,097 | B1 * | 9/2006 | Lam | H01R 25/003 439/654 |
| 7,445,513 | B1 | 11/2008 | Lee | |
| 8,222,773 | B2 | 7/2012 | De | |
| 8,261,109 | B2 | 9/2012 | Kim | |
| 8,415,920 | B2 | 4/2013 | Liao | |
| 8,469,730 | B2 | 6/2013 | Garb | |
| 8,868,939 | B2 | 10/2014 | Matsuoka | |
| 8,896,150 | B1 * | 11/2014 | Shammoh | H01R 13/70 307/31 |
| 9,099,802 | B2 | 8/2015 | Beharrell | |
| 2002/0147036 | A1 | 10/2002 | Taguchi | |
| 2004/0104705 | A1 | 6/2004 | Frerking | |
| 2004/0121648 | A1 * | 6/2004 | Voros | H01R 13/6215 439/535 |
| 2004/0133716 | A1 | 7/2004 | Lee | |
| 2005/0122650 | A1 | 6/2005 | Beasley | |
| 2009/0146494 | A1 * | 6/2009 | Mori | G06F 1/266 307/38 |
| 2011/0086527 | A1 * | 4/2011 | Ruffner | H01R 27/00 439/105 |
| 2011/0287665 | A1 * | 11/2011 | Chien | F21S 8/035 439/638 |
| 2012/0064772 | A1 | 3/2012 | Pocrass | |
| 2013/0285609 | A1 | 10/2013 | Clouser | |
| 2015/0001937 | A1 * | 1/2015 | Wang | H01R 13/70 307/52 |
| 2015/0038019 | A1 | 2/2015 | Lee | |
| 2015/0077243 | A1 | 3/2015 | Hooper | |
| 2015/0077926 | A1 | 3/2015 | Schneider | |
| 2015/0118896 | A1 * | 4/2015 | Shomali | H01R 13/5224 439/540.1 |
| 2017/0033566 | A1 * | 2/2017 | Jursch | H02J 5/00 |

OTHER PUBLICATIONS

"Convenient Desktop Power Outlets," Cable Ties and More,cabletiesandmore.com, © 2015, accessed: Aug. 2015. http://www.cabletieandmore.com/fastpower.php.

"F13658 Allocacoc New Power Strip USA PowerCube 5 Outlets Portable Power Outlet Socket—FS," AliExpress, aliexpress.com, seller: Shenzhen Feichao Technology Co., Ltd., © 2015, accessed: Aug. 2015. http://www.aliexpress.com/item/F13658AllocacocNewPowerStripUSAPowerCube5OutletsPortablePowerOutletSocketFS/32325183233.html.

"10 Outlet Extension Socket with 8 USB and 1.8m power(power socket, tomada,adapter))," AliExpress, aliexpress.com, seller:Jinli Electric Livolo, © 2015, accessed: Aug. 2015. http://www.aliexpress.com/item/FREESHIPPINGJLTU102810OutletExtensionSocketwith16USBand18mpower/1994532280.html.

Ivan, Emil, "BlueLounge Portiko Portable MultiOutlet Extension Cord," Cool Pile, coolpile.com, © 2012, accessed: Aug. 2015. http://coolpile.com/tag/chargingstations.

"Moiré™ Desktop Power & Data Outlet," CableOrganizer®, cableorganizer.com, © 2015, accessed: Aug. 2015. http://www.cableorganizer.com/p/moire-desktop-power-data-outlet/.

* cited by examiner

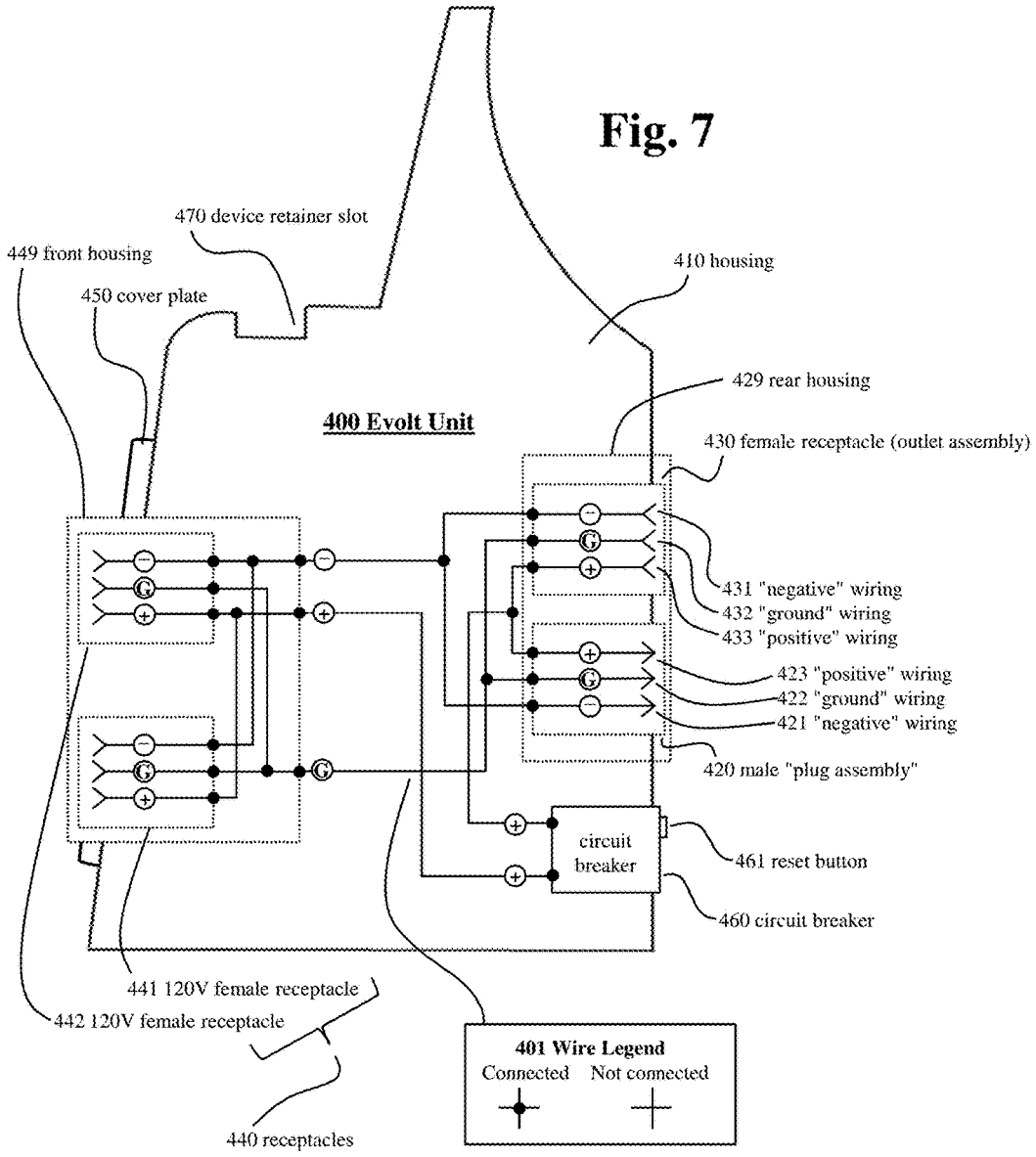
Fig. 7
470 device retainer slot
449 front housing
450 cover plate
410 housing
429 rear housing
400 Evolt Unit
430 female receptacle (outlet assembly)
431 "negative" wiring
432 "ground" wiring
433 "positive" wiring
423 "positive" wiring
422 "ground" wiring
421 "negative" wiring
420 male "plug assembly"
circuit breaker
461 reset button
460 circuit breaker
441 120V female receptacle
442 120V female receptacle
440 receptacles
401 Wire Legend
Connected
Not connected 610 housing
600 Evolt Unit (device)
630 female receptacle (outlet assembly)
USB port (charger)
620 male "plug assembly"
circuit breaker
660 circuit breaker
641 120 volt female receptacle
642 USB port
601 Wire Legend
Connected
Not connected

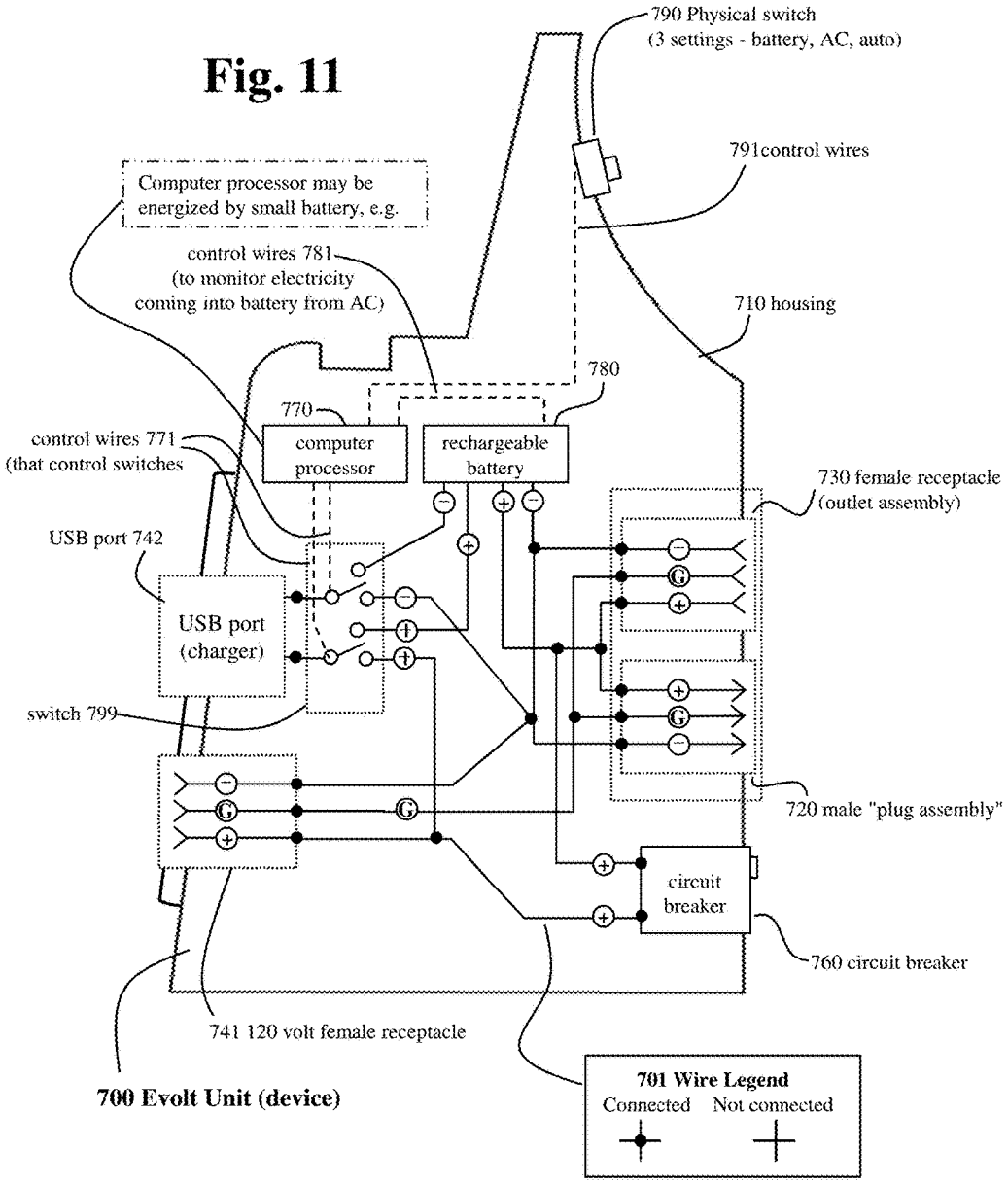
Fig. 11
790 Physical switch
(3 settings - battery, AC, auto)
791control wires
Computer processor may be energized by small battery, e.g.
control wires 781
(to monitor electricity coming into battery from AC)
710 housing
780
770
computer processor
rechargeable battery
control wires 771
(that control switches
730 female receptacle
(outlet assembly)
USB port 742
USB port
(charger)
switch 799
720 male "plug assembly"
circuit breaker
760 circuit breaker
741 120 volt female receptacle
700 Evolt Unit (device)
701 Wire Legend
Connected
Not connected

DEVICES AND METHODS FOR PROVIDING ELECTRICAL POWER

RELATED PATENT APPLICATION AND PRIORITY

This application claims priority to U.S. Provisional Patent Application 62/152,894 filed Apr. 26, 2015, the content of which is incorporated herein by reference in its entirety.

BACKGROUND OF THE INVENTION

Electrical power is an important component for a wide variety of tasks that we do. However, there often exists a problem of not having easy access to electrical power when it is needed. Illustratively, there exists a problem of not having quick easy access to electrical power in the common environment of a desk or other workspace, as well as in various spaces around the home.

The invention addresses these and other problems.

BRIEF SUMMARY OF THE INVENTION

Devices and methods are described to provide electrical power. A device of the invention may comprise a housing portion that includes:

(A) a plug assembly including positive and negative prongs, outwardly facing, for interfacing with a female cord end, the plug assembly disposed in the interior space and supported by the at least one vertical wall at a back of the housing portion;

(B) a first outlet assembly including positive and negative apertures, outwardly facing, for interfacing with a male cord end, the first outlet assembly disposed in the interior space and supported by the at least one vertical wall at a back of the housing portion;

(C) a first wire route, and the negative prong of the plug assembly being in direct connection, via the first wire route, with the negative aperture of the first outlet assembly;

(D) a second wire route, and the positive prong of the plug assembly being in direct connection, via the first wire route, with the positive aperture of the first outlet assembly;

(E) a second outlet assembly including at least one receptacle for interfacing with a male cord end, the second outlet assembly disposed in the interior space and supported by the at least one vertical wall at a front of the housing portion, the second outlet having a negative connection and a positive connection;

(F) a third wire route, and the negative prong of the plug assembly being in connection, via the third wire route, with the negative connection of the second outlet assembly;

(G) a wire assembly, and the positive prong of the plug assembly being in connection, via the wire assembly, with the positive connection of the second outlet assembly; and the wire assembly including a fourth wire route, circuit breaker, and fifth wire route connected in sequence serving to connect the positive prong of the plug assembly with the positive connection of the second outlet assembly. Alternatively, the negative polarity wires may be associated with the circuit breaker.

BRIEF DESCRIPTION OF THE DRAWINGS

The present invention can be more fully understood by reading the following detailed description together with the accompanying drawings, in which like reference indicators are used to designate like elements, and in which:

FIG. 7 is a schematic diagram showing wiring of a device 400, in accordance with one embodiment of the invention.

FIG. 11 is a further schematic diagram showing wiring of a device with a computer, in accordance with one embodiment of the invention.

DETAILED DESCRIPTION OF THE INVENTION

Figure 1:
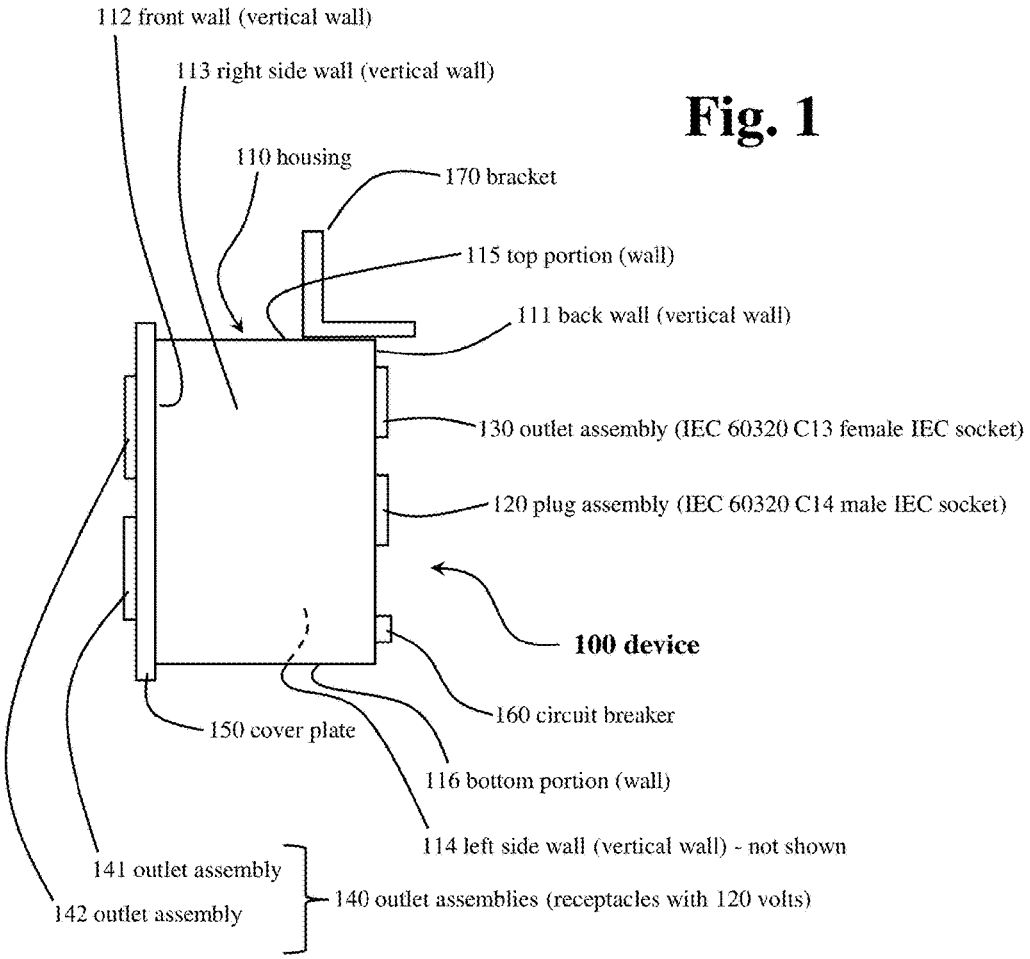
FIG. 1 is a side view of a device 100 in accordance with one embodiment of the invention.

Hereinafter, aspects of devices and methods in accordance with various embodiments of the invention will be described. As used herein, any term in the singular may be interpreted to be in the plural, and alternatively, any term in the plural may be interpreted to be in the singular.

Electrical power is an important component of a wide variety of tasks that we do. However, there often exists a problem of not having easy access to electrical power when it is needed. Illustratively, there exists a problem of not having quick easy access to 120 volts of electrical power in the common environment of a desk. The device and methodology of the invention addresses this and other problems.

In further explanation of the invention, not having quick and easy access to electrical power (such as 120 volt electrical power commonly used in the US and sometimes referred to as "mains" power, for example) on top of your computer desk area, side table, nightstand, or other work surface is a problem for many people. As should be appreciated, various devices, gadgets, and other items that need electrical power are often utilized in such an environment. However, the source of such electrical power is often positioned on the wall behind such a work surface and difficult to access. Oftentimes, a person may be forced to perform the difficult task of moving a work surface and accessing an outlet behind a work surface, for example.

The invention addresses these and other problems. The invention provides a device in the form of a small portable receptacle. The device supplies electricity to multiple gadgets and also, in accordance with one embodiment of the invention, serves as a computer monitor's power source. The device of the invention sits on top of a desk or table or other surface upon which a person might use a desktop computer, for example.

The device of the invention, which may be characterized as an "Evolt" or "Evolt 365" device, may be installed by a wide variety of persons, including both skilled and unskilled persons in the area of electronics. Further, the device can take on a wide variety of looks including wood-tone, stainless, or black colored—just to name a very few. Indeed, the design color choices that may be applied to the device are innumerable. Further, the device can be constructed in a wide variety of designs and shapes. Such designs and shapes might include dice, pyramid, animal shapes, and sports related shapes such as in the shape of a football, soccer ball or other object.

As described in detail below, the various designs and shapes possess a core electrical wiring layout of the invention. Accordingly, one advantage of the device of the invention is to provide a highly useful source of electrical power in the environment of a work surface, for example, in conjunction with providing a highly variable look to suit individual users. In particular, the look may be varied by changing out a cover plate, i.e. a faceplate, on the front of the device.

The device of the invention may be used in a wide variety of environments as described herein. Illustratively, the device of the invention may be placed by your bedside, on top of your nightstand, or next to an end table, for example. The device provides highly accessible electrical power in an aesthetically pleasing manner.

There is no electrician or handyman needed to connect and utilize the device of the invention. Illustratively, the device is portable, easy to carry and installs in seconds. In particular, the device of the invention may be used in conjunction with a cord of a computer monitor. The device provides an easy to use GFCI and/or circuit breaker protected 120 volts of electrical power to plug in personal devices, such as an iPhone, iPad, Bluetooth earpiece, household vacuum cleaner, and a wide variety of other devices. The device provides the ability for a person to plug in (on his or her desktop) in seconds versus fumbling behind a desk in an effort to gain access to electrical power—that often includes the need to go and find an extension cord and move heavy items. Accordingly, the device of the invention effectively brings an outlet to the user from behind the computer desk, couch, nightstand, or furniture, for example.

As described further below, the invention may be in the form of a portable box that sits on the top of the user's desk or wherever else the user may choose to place the device of the invention. As noted above, the device of the invention may be powered by the cord that now powers your computer monitor.

FIG. 1 is a side view of a device 100 in accordance with one embodiment of the invention. As shown, the device 100 includes a plug assembly 120. The plug assembly 120 is the power source for the device. The plug assembly 120 may take on a variety of forms (including possessing male connectors) so as to plug into a power source. Illustratively, the plug assembly 120 may be in the form of a IEC 60320 C14 type male power socket. Such a C14 type male power socket (as the plug assembly 120) receives an IEC 60320 C13 female connector.

In further explanation of FIG. 1, the device 100 includes a housing 110. The housing 110 houses a variety of components. One of these components is the plug assembly 120 described above. The device 100 also includes an outlet assembly 130. The outlet assembly 130 may take on a variety of forms so as to function as a power source, i.e. such that a user may plug into the outlet assembly 130 to access electrical power. Illustratively, the outlet assembly 130 may be constituted by a IEC 60320 C13 female IEC socket. Accordingly, a first monitor cable may connect the plug assembly 120 into a wall outlet (in a person's home for example)—and a second monitor cable connect the outlet assembly 130 to a monitor, such as for a personal computer.

The device 100 also includes receptacles 140, i.e. outlet assemblies. Specifically, receptacles 140 may include a receptacle 141 and a receptacle 142. The receptacles 140 may be in the form of a common household outlet. Accordingly, the device 100 may be disposed on a person's desk in such manner that the person can plug any of a wide variety of devices into the receptacles 140—and access a source of electricity.

The device 100 also includes a cover plate 150. As described in further detail below, the cover plate 150 may be "switched out" by a user so as to provide any of a wide variety of aesthetically pleasing looks to the device.

Additionally, the device 100 includes a circuit breaker 160, as shown in FIG. 1. In accordance with one embodiment of the invention, the circuit breaker 160 is a distinction between the outlet assembly 130 (disposed at the back of the device) and the outlet assemblies 140 disposed at the front of the device. To explain more specifically, the outlet assembly 130 is directly wired to the source of electrical power coming in via the plug assembly 120. As used herein, "directly wired" means that only wires, connectors for the wires, and/or switches to connect the wires provided passage of electricity between a first component and a second component, i.e. thus not including components such as the circuit breaker 160. Accordingly, "directly wired" does include one wire and/or multiple wires connected with a suitable connector. Such suitable connector might include a conical threaded wire nut, for example. However, as used herein, "directly wired" does not encompass an arrangement with a further component, such as the circuit breaker 160.

With the above meaning (as used herein) of "directly wired"—in accordance with one embodiment of the invention, the plug assembly 120 is directly wired to the outlet assembly 130, i.e. along what is herein characterized as a "wire route". This means that both the positive and negative conduits of electricity between the plug assembly 120 and the outlet assembly 130 travel in an unimpeded manner through wires along a "wire route" (i.e. unimpeded by any other components such as a circuit breaker). However, in contrast to such arrangement, the outlet assemblies 140 are not directly wired to the plug assembly 120. As described in further detail below, at least one of the positive or negative conduits of electricity passing between the plug assembly 120 and each outlet assembly 140 passes through the circuit breaker 160.

Relatedly, hereinafter such aspects of the invention will be illustratively described in the context of a monitor connection. FIG. 1 shows a C13 female socket that may be utilized to provide power to a user's PC monitor. The C13 power socket is not wired to the circuit breaker 160. The circuit breaker 160 is wired only to the outlet assemblies 140, i.e., the receptacles 140 and/or universal serial bus (USB) receptacle as is described further below. Accordingly, if there is an overload on the front receptacles, the circuit breaker 160 shuts off power to the front receptacles only. This arrangement also enables the device of the invention to be "daisy chained" because each device 100 has its own built in breaker to protect itself by shutting off power to its front receptacles 140 only. Power supply to connected daisy chained devices will not be affected by any other in-line connected device's circuit breaker tripping. Accordingly, such uninterrupted power to other devices of the invention is a notable part in how the device of the invention functions. That is, it does not matter if one or two circuit breakers 160 (in respect of devices 100) were to trip in a daisy chained system. So multiple devices 100 can be connected together to provide a safe power source to desks, cubicles, booths, or in any other arrangement as desired—thus effectively providing multiple power sources from one outlet.

Accordingly, the outlet assembly 130 provides power to a computer monitor uninterrupted by the circuit breaker 160, i.e. the circuit with the outlet assembly 130 is not provided with a circuit breaker. In particular, the outlet assembly 130 (i.e. a socket) may receive an IEC 60320 C13 to IEC 60320 C14 power cord—i.e. to electrically connect the outlet assembly 130 to a monitor (in such manner so as to power the monitor).

Accordingly, to further explain in a different manner, the IEC 60320 C14 and IEC 60320 C13 sockets/connectors are wired inside the housing 110 in such a way as to provide 120 volts of power to the outlet assemblies 140 (on the front of the device) without interrupting the power to the monitor source C13 (i.e. the outlet assembly 130). That is, power to the outlet assemblies 140 is independent from power to the outlet assembly 130. Relatedly, and as otherwise described herein, the outlet assemblies 140 may be constituted and/or accompanied by USB assemblies and/or other assemblies that are potentially interrupted by the circuit breaker 160.

Relatedly, it is appreciated that the systems and methods of the invention are not limited to particularly the circuit breaker 160 providing protection to devices plugged into the front of the device—be it 120 volt outlets, USB receptacles, and/or other arrangements to provide power. Rather, other components (in lieu of the circuit breaker 160) might be utilized to so control voltage in the device 100. Accordingly, the circuit breaker 160 (or other component provided to limit electrical power in the case of a problem) protects the device 100, the user, and the monitor connected to the device 100, as well as various other electronics that are attached and plugged into the front of the device 100.

The device 100 can be used as a standalone or as described above may be used with a PC monitor's power cord with a monitor, for example. In accordance with one embodiment of the invention, the device 100 will need a C13 detachable power cord plugged in the back to be energized, i.e. in the arrangement in which the plug assembly 120 is so configured for IEC 60320 C13 plug. Relatedly, many desktop PC monitor screens, flat screen TVs, and numerous other devices in use today have a C14 type power source and will accept a C13 power plug.

Relatedly, in accord with the method of the invention, an IEC 60320 C13 power plug is removed from the back of the user's monitor and plugged into the back of the device 100—and specifically plugged into the plug assembly 120. The device 100 will then be energized with 120 volts. To put power back to the user's PC monitor, the user will then plug an IEC 60320 C14/C13 power cord into the outlet assembly 130 (C14 end) and the other end (C13) to the user's monitor.

FIG. 1 shows additional features of the invention. Specifically, the housing 110 may be constructed of a plurality of walls and/or similar structure. The housing may be constructed in various shapes, and indeed may be round. The housing 110 may include a back wall 111, a right sidewall 113 and a front wall 112. Further, the housing 110 may include a left sidewall 114, which is not shown in FIG. 1. Accordingly, the back wall 111, the front wall 112, the right sidewall 113, and the left sidewall 114 collectively form a series of vertical walls that are connected and serve to confine and retain the various components disposed within the housing 110. As shown in FIG. 1, it is of course appreciated that the housing 110 is provided with suitable openings and/or apertures so as to provide access (as desired) to the various components within the housing 110. In particular, such access affords the ability to plug cables into and/or remove cables from the device 100, for example. As noted above, it is appreciated that the device 100 is not limited to the particular geometrical structure shown in FIG. 1. Illustratively, the device may be of a round configuration or some other configuration as desired. The housing 110 may further include a bottom portion or wall 116, as well as a top portion or wall 115. The bottom portion 116 and the top portion 115 may also be varied in configuration. Illustratively, as described in further detail below, the top portion 115 may be molded into a curved and varied shape so as to retain a personal device, such as a cell phone.

In the particular embodiment of FIG. 1, the device includes a bracket 170. The bracket 170 may be provided to retain a personal device such as a cell phone or other device, and may include a cushion of other retaining mechanism.

Hereinafter and relatedly, further features of the device 100 will be described. The device may be produced to have a weighted bottom and/or suction cups and/or clips on the bottom to help keep the device on a work surface. Accordingly, structure may be provided to keep the device in place while resting on a desk top. The bottom of the device may be provided with soft feet to protect the surface upon which the device rests. For example, the device 100 may be provided with felt type feet to protect a desk top. In accordance with one aspect of the invention, once connected to the user's monitor's power cord, the circuit breaker protected receptacles 140 (and/or USB outlets) will become energized with electricity and be ready for use. Illustratively, in the US, the device will become energized with approximately 120 volts of electricity. The device may be made with a combination of multiple USB ports and any number of receptacles/outlets as the outlet assemblies 140. For example, the device 100 might be provided on the front with 2 USB ports and 2 to 4 receptacles/outlets.

It should be appreciated, the device provides a variety of advantages. There is no longer a need to lay an extension cord out to a wall receptacle behind your computer desk. There is no longer a need to move your desk to gain access to a wall receptacle. The device provides an easy way to access power quickly and effectively—by converting the 120 volt power source of your desktop monitor to a usable power source, in addition to continuing to power your monitor. The device may be placed on the nightstand, table, fireplace mantel, or any other surface as desired so as to provide easy access to power. Once the device of the invention is in place, you won't have to move a bed, couch or other furniture to gain access to those hard to reach wall outlets.

Figure 2:
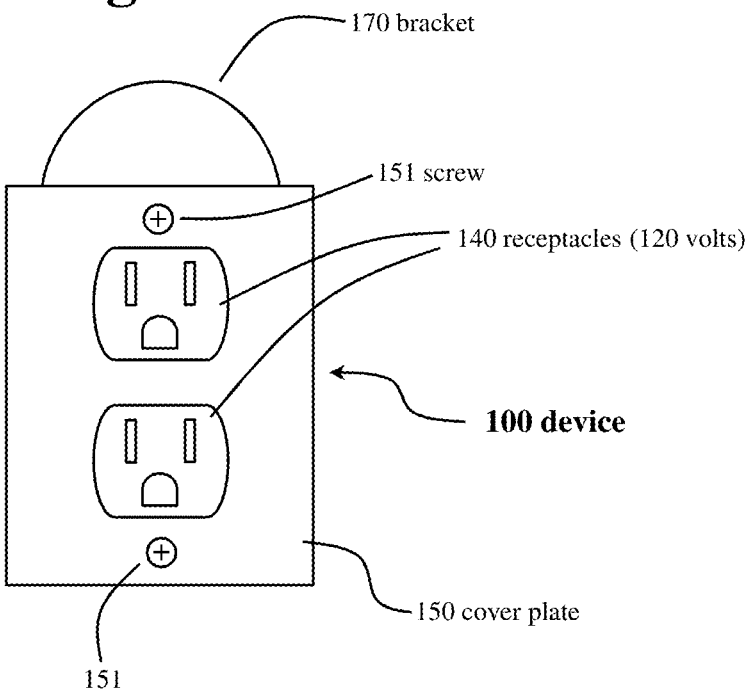
FIG. 2 is a front view of the device 100 in accordance with one embodiment of the invention.

FIG. 2 is a front view of the device 100 in accordance with one embodiment of the invention. As shown and described above, the device 100 includes two receptacles 140. These two receptacles may illustratively (in the United States) provide 120 volts of electricity. It is of course appreciated that the receptacles 140, and the voltage provided thereby, may be varied depending on the standards in the particular area of the world—in which the device is to be used.

As shown in FIG. 1 and FIG. 2, the device 100 may include a cover plate 150. The cover plate 150 may be attached to the housing 110 using any suitable attachment mechanism, such as the screws 151 shown in FIG. 2. The cover plate 150, as well as the receptacles 140, may be made with many variations of colors, white-toned, stainless steel, black colored, or any other coloration or design as desired. Relatedly, it is appreciated that the housing 110, the cover plate 150, and the various other components of the device may be constructed of any material as may be desired. For example, the device 100 might be constructed of plastic and/or metal but is of course not limited to these materials.

Figure 3:
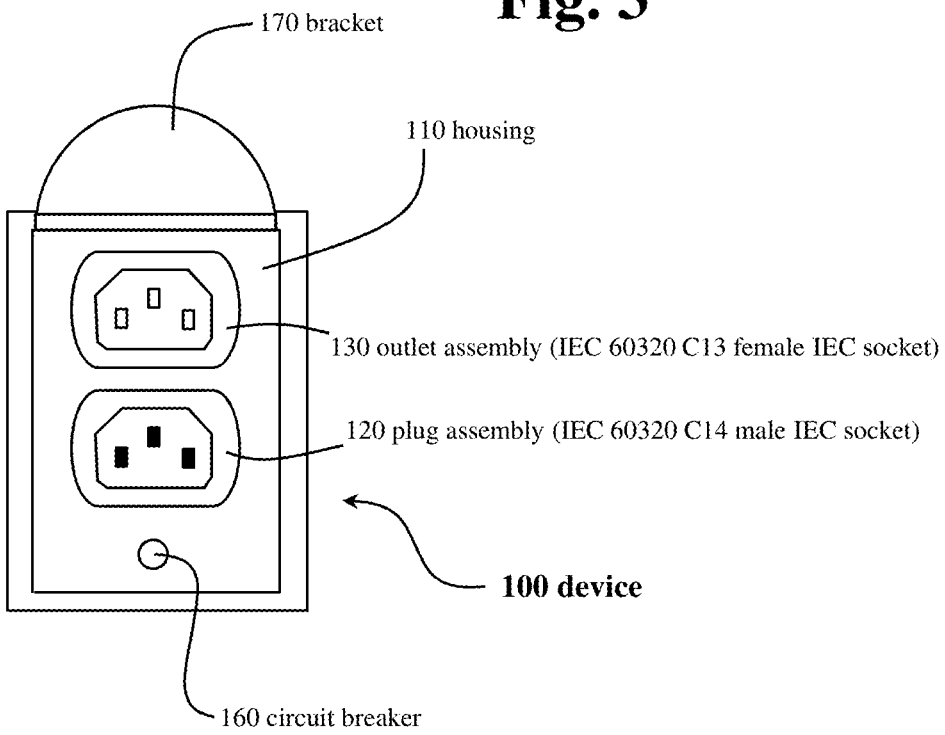
FIG. 3 is a back view of the device 100 in accordance with one embodiment of the invention.

FIG. 3 is a back view of the device 100 in accordance with one embodiment of the invention. As shown in FIG. 3, the device 100 includes the plug assembly 120 and the outlet assembly 130. It is appreciated that one advantage of the device 100 of the invention is that it utilizes a standardized cable, i.e. a IEC 60320 C13/C14 cable. The invention is not limited to such standardized cable. However, it is appreciated that the use of some standardized cable is beneficial in that it enhances the mating between the particular cable utilized vis-à-vis the interface with the device 100. Such is in contrast to the use of extension cords that may vary substantially in structure of the ends.

The device of the invention, in accordance with various embodiments, may be varied in a particular manner in which the device is presented to a user, i.e., in the environment of marketing and selling the device to a user. For example, as a first version, the device may be a complete and functional appliance when purchased from a seller, retailer or some other entity. In this first version, the device 100 is simply removed from the packaging and is ready for use. However, in accord with other embodiments of the invention, the device may be sold as a put together kit sold as incomplete. It is envisioned that such device would include the housing 110. However, the particular components sold in conjunction with the housing may vary as desired. For example, various components and wiring may be provided but with the customer buying a faceplate and receptacle 140 separately. Illustratively, such faceplate and receptacle 140 might be purchased from a hardware store to install and complete the device and make the device a functional appliance. In the second scenario, the user is provided the ability to make a choice as to what colors the user would like for the décor of the device—in particular as that décor is controlled by the cover plate 150 (i.e. the faceplate) and receptacles 140. Relatedly, it is appreciated that a user may readily change out the cover plate 150 as may be desired.

Figure 4:
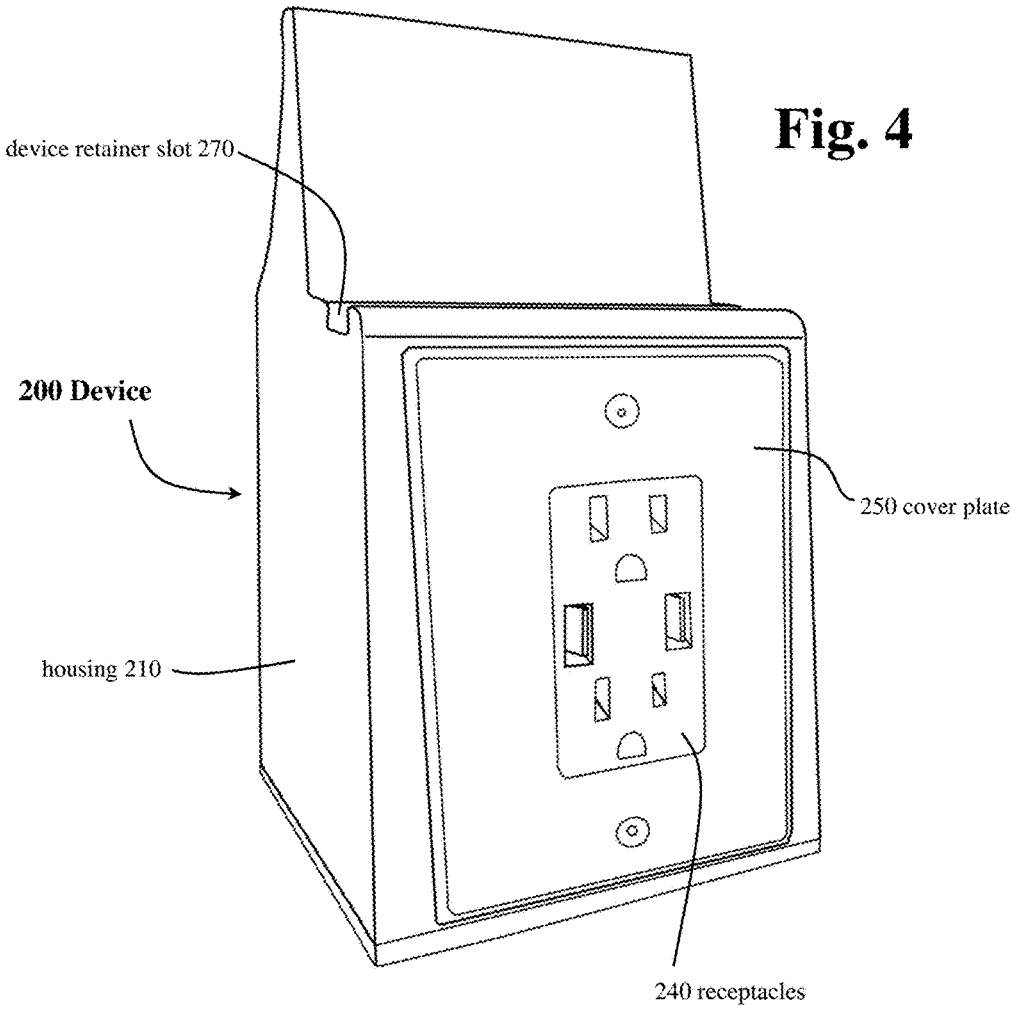
FIG. 4 is a perspective view of a device 200 in accordance with a further embodiment of the invention.
Figure 5:
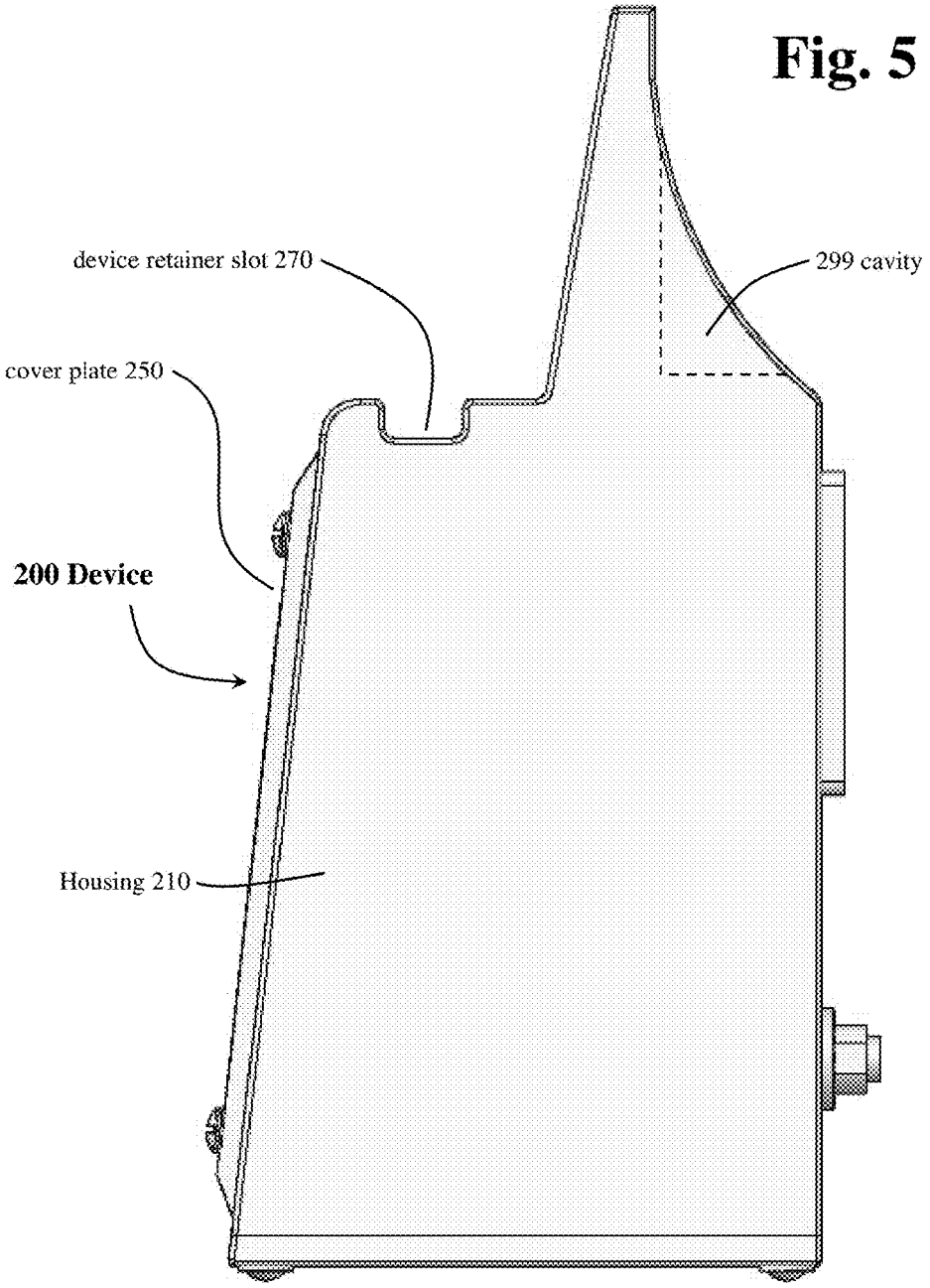
FIG. 5 is a side view of the device 200 of FIG. 4, in accordance with one embodiment of the invention.

FIG. 4 is a perspective view of a device 200 in accordance with a further embodiment of the invention. Further, FIG. 5 is a side view of the device 200 of FIG. 4, in accordance with one embodiment of the invention.

The device 200 includes a housing 210 in which various components are housed. In similar manner to the device 100 of FIG. 1, the device 200 of FIG. 4 includes receptacles at the front of the device. Specifically, the device 200 includes receptacles 240. The receptacles 240 include both AC 120 volt receptacles, in similar manner to those described above and shown in FIG. 1. The receptacles 240 also include USB outlets. As described in further detail below, the receptacles 240 may be protected utilizing a circuit breaker as described above.

The housing 210 is different from the housing described above with reference to FIG. 1. Specifically, the housing 210 may be provided with slanting and curved surfaces which may be more aesthetically pleasing to some users. In similar manner to the device of FIG. 1, a cover plate 250 may be mounted on the housing 210. The cover plate 250 may be switched out by the user as desired.

The housing 210 may be integrally provided with a device retainer slot 270. The device retainer slot 270 affords a holder—for a wide variety of devices and items. In particular, the device retainer slot 270 may be utilized by the user to hold a cell phone, tablet or other personal device. However, it is appreciated that the device retainer slot 270 may retain any other item as may be desired by the user. For example, the retainer slot 270 might retain a document, credit card, or any other device or item. The retainer slot 270 may include suitable cushioning as may be desired. Such cushioning may both provide a cushion to a device or item disposed in the retainer slot 270, as well as provide a gripping surface. In similar manner, the bracket 170 (of the embodiment of FIG. 1) may be provided with a cushion, edge and/or a groove so as to assist in retaining an item or a device.

FIG. 5 shows the housing 210 includes a cavity 299 disposed at the top of the housing. The cavity 299 may be utilized to hold various items as desired—such as rings, earbuds, other earpieces, and other items as may be desired. While not shown, the cavity 299 may be varied in structure to hold other items as desired, such as a pocket to hold pencils.

Figure 6:
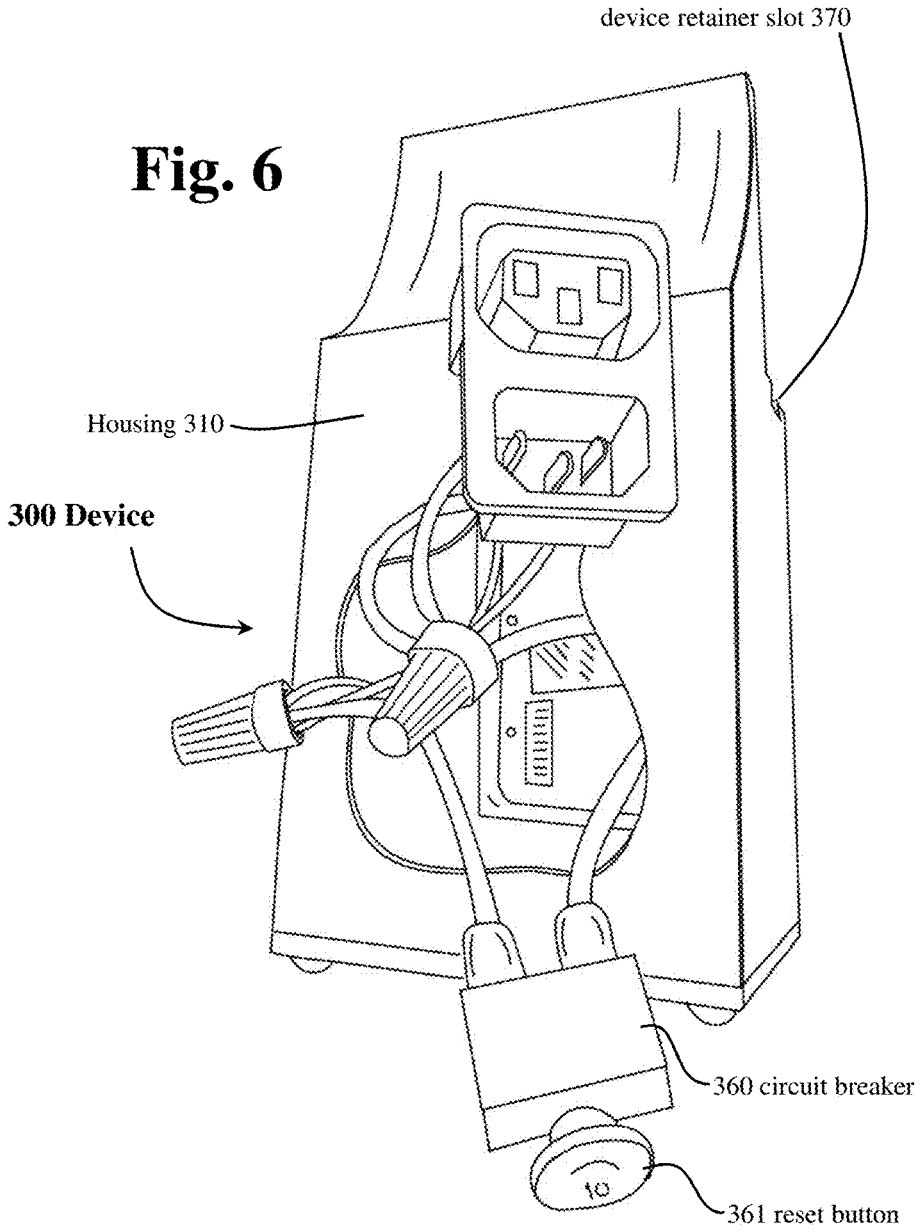
FIG. 6 is a perspective exploded view, in accordance with one embodiment of the invention.

In further illustration of the invention, FIG. 6 is a perspective exploded view, in accordance with one embodiment. The device 300 of FIG. 6 includes a housing 310 and a device retainer slot 370. Further, the device 300 includes various of the components described above including a circuit breaker 360 with the reset button 361. FIG. 6 also shows male and female sockets disposed at the back of the device 300. FIG. 6 also shows various wires that serve to connect the components of the device 300.

Relatedly, FIG. 7 is a schematic diagram showing wiring of a device 400, in accordance with one embodiment of the invention. The device 400 may be similar in structure to the device shown in FIG. 6. The device 400 includes receptacles 440. The receptacles 440 include two female receptacles 441 and 442. These may be disposed in a front housing 449. The device 400 also includes a circuit breaker 460 with reset button 461.

The device 400 also includes a male plug assembly 420 and female receptacle 430. These may be housed in a rear housing 429.

FIG. 7 also shows illustrative wiring in accordance with one embodiment of the invention. The wiring of FIG. 7 is shown with annotation. Illustratively, the wiring includes negative wiring 431, ground wiring 432, and positive wiring 433 associated with a female receptacle 430. Illustratively, the wiring includes negative wiring 421, ground wiring 422, and positive wiring 423 associated with the female receptacle 430. Connections between the various wires are reflected in the wire legend 401.

In particular, and as described above, FIG. 7 illustrates that the plug assembly 420 is connected directly to the outlet assembly 430. In contrast, the receptacles 440 are connected to the plug assembly 420 via a circuit breaker 460

Figure 8:
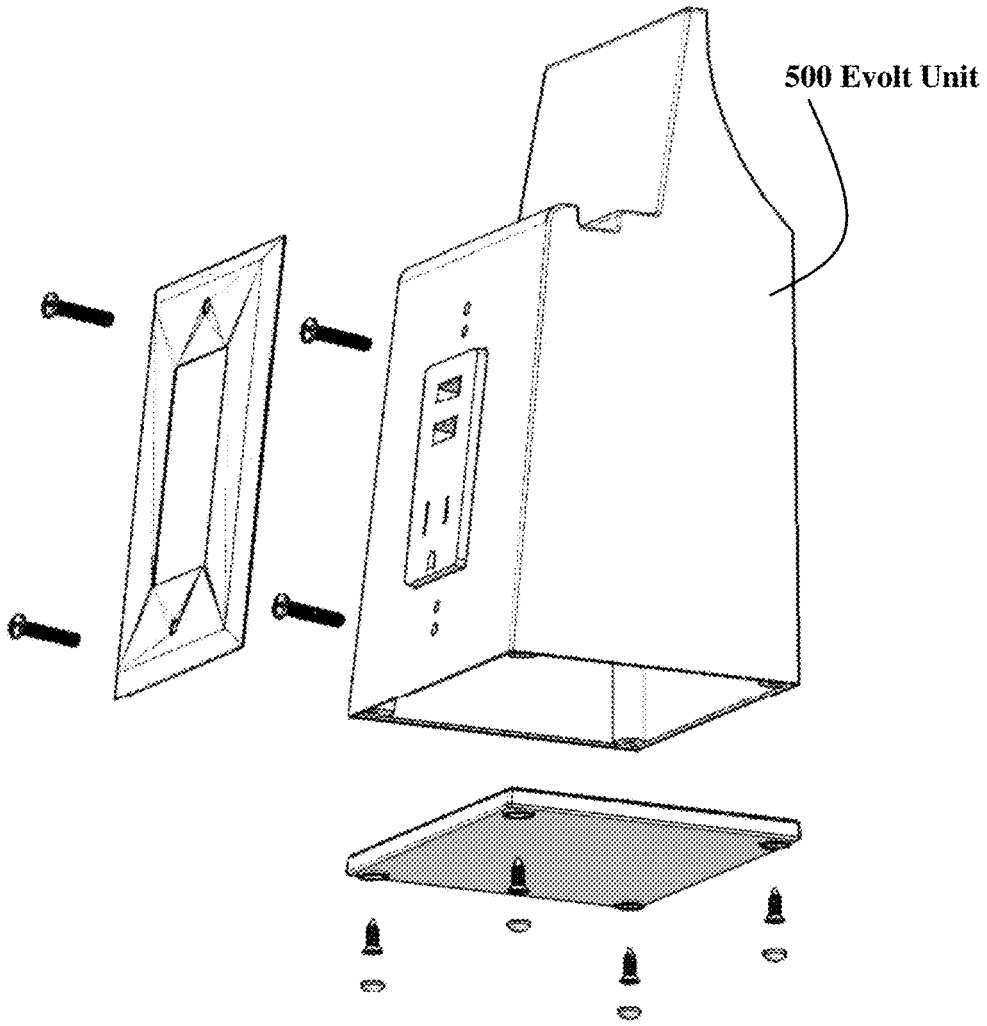
FIG. 8 is a perspective, exploded view of a further device in accordance with one embodiment of the invention.

FIG. 8 is a perspective, exploded view of a further device in accordance with one embodiment of the invention. The device 500 of FIG. 8 shows further aspects of the structure of the device. In particular, FIG. 8 shows features of the bottom portion, cover plate at the front of the device, and various screws to hold the device together.

Figure 9:
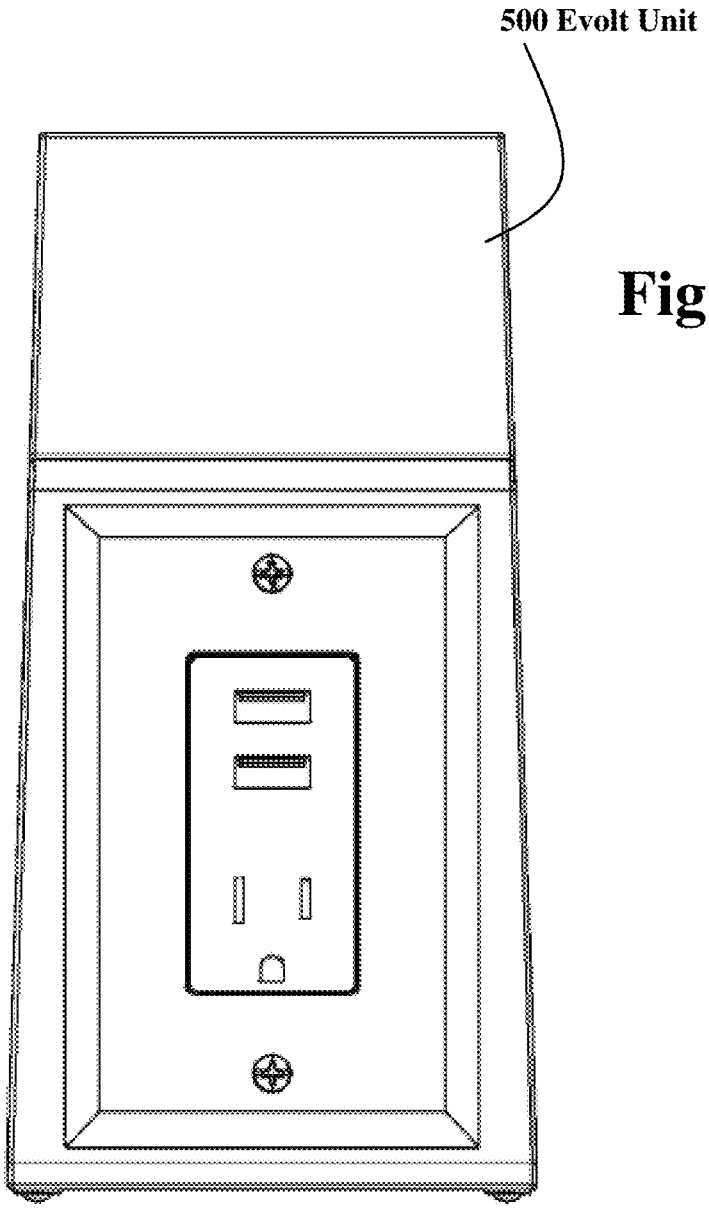
FIG. 9 is a front view of the device of FIG. 8, in accordance with one embodiment of the invention.

FIG. 9 is a front view of the device of FIG. 8, in accordance with one embodiment of the invention. Specifically, FIG. 9 is provided to show an assembled view of the device of FIG. 8.

Figure 10A:
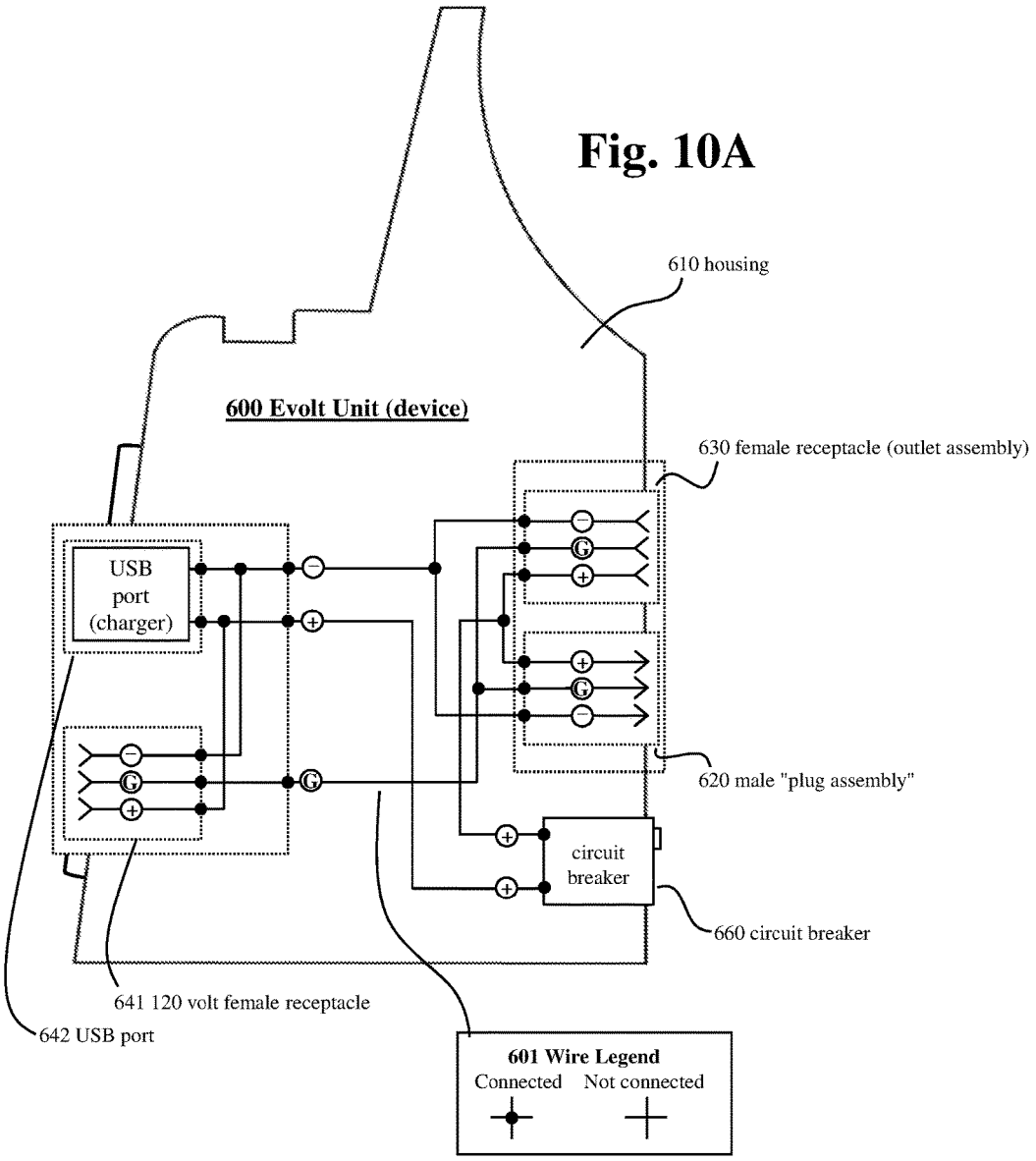
FIG. 10A is a further schematic diagram showing wiring of a device, in accordance with one embodiment of the invention.

FIG. 10A is a further schematic diagram showing wiring of a device, in accordance with one embodiment of the invention. A similar manner to FIG. 7 described above, the device 600 includes a plug assembly 620 and an outlet assembly 630, disposed in a housing 610.

In contrast to the device of FIG. 7, the device 600 of FIG. 10A has one female receptacle 641 disposed on the front of the device 641, and a USB port 642 disposed on the front of the device 600. Both the female receptacle 641 and the USB port 642 are in circuit with the circuit breaker 660. A wire legend 601 reflects connection of the wiring between the various components of FIG. 10A.

Figure 10B:
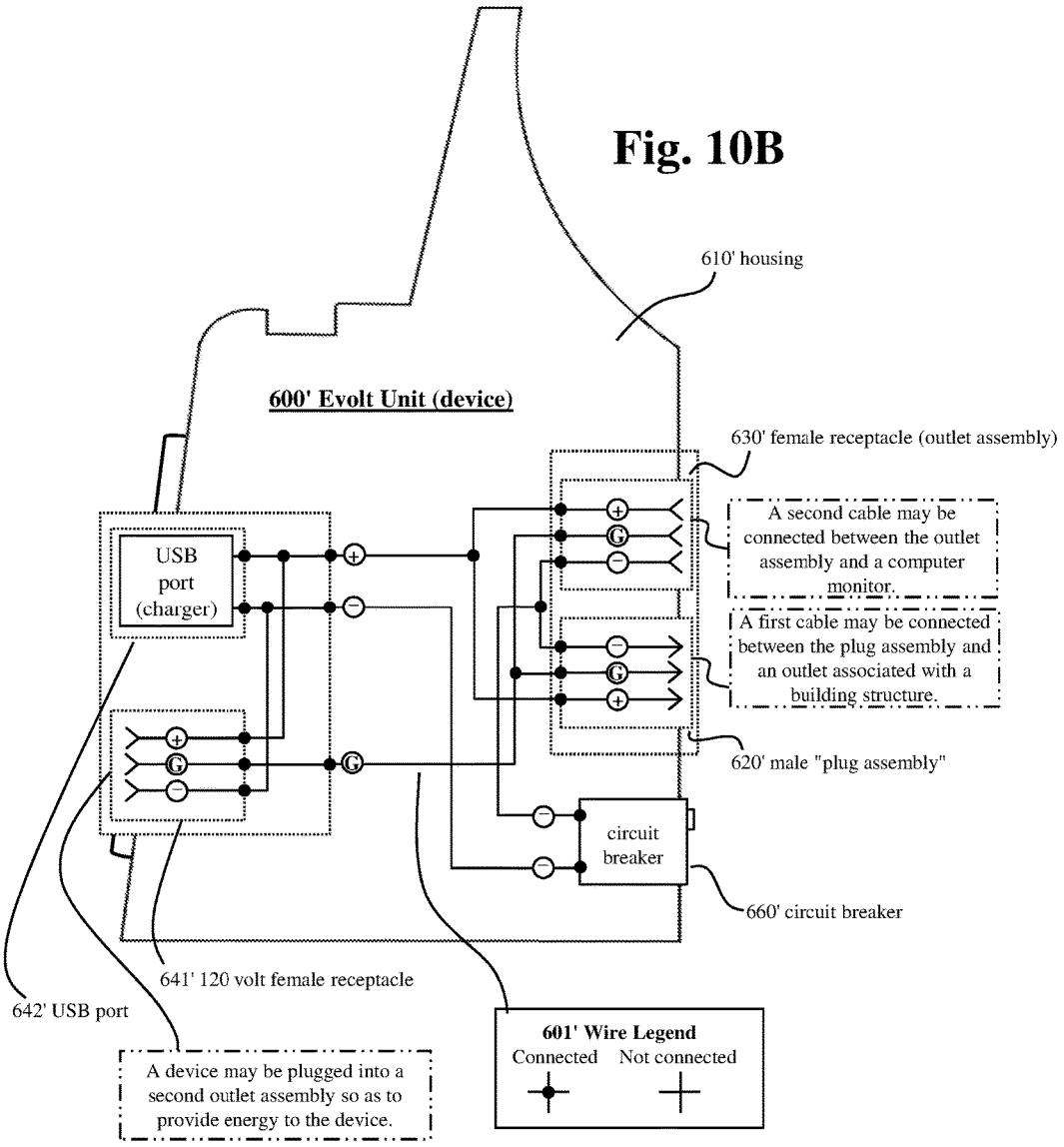
FIG. 10B is a further schematic diagram showing wiring of a device, in accordance with one embodiment of the invention.

FIG. 10B is a further schematic diagram showing wiring of a device, in accordance with one embodiment of the invention. The device 600' includes a plug assembly 620' and an outlet assembly 630', disposed in a housing 610'.

The device 600' of FIG. 10B has one female receptacle 641' disposed on the front of the device 641', and a USB port 642' disposed on the front of the device 600'. Both the female receptacle 641' and the USB port 642' are in circuit with the circuit breaker 660'. A wire legend 601' reflects connection of the wiring between the various components of FIG. 10B.

In accord with features otherwise described herein, FIG. 10B shows that negative polarity wires may be associated with the circuit breaker. In contrast, in FIG. 10A, positive polarity wires are associated with the circuit breaker.

FIG. 10B also shows that a first cable may be connected between the plug assembly and an outlet associated with a building structure. FIG. 10B also shows that a second cable may be connected between the outlet assembly and a computer monitor. FIG. 10B also shows that a device may be plugged into a second outlet assembly so as to provide energy to the device.

FIG. 11 is a further schematic diagram showing wiring of a further device, in accordance with one embodiment of the invention. In similar manner to FIG. 10, the device 700 of FIG. 11 includes a housing 710, a male plug assembly 720, a female receptacle 730, a female receptacle 741 (disposed on the front of the device), a USB port 742 (disposed on the front of the device), and a circuit breaker 760.

In this embodiment, the USB port 742 may be powered by electricity coming into the male plug assembly 720. However, the device 700 also includes a rechargeable battery 780. Rechargeable battery 780 may be charged over the course of time by such electricity coming into the plug assembly 720. Relatedly, the rechargeable battery 780 may automatically stop charging once a full charge is attained.

In the device 700 FIG. 11, the device also contains a computer processor 770. The computer processor 770 controls whether the USB port draws electricity from the rechargeable battery 780 or the plug assembly 720. For example, the computer processor 770 may detect (via control wires 781) the amount of electricity coming into the rechargeable battery 780. This observed flow of electricity/current is representative of the electricity/current seen by the USB port 742 and the receptacle 741. Accordingly, if the computer processor 770 determines that the electricity observed drops below some predetermined threshold, then power input into the USB port 742 may be switched (via switch 799) from the plug assembly 720 to the battery 780. The computer controls the switch 799 via control wires 771, in accordance with one embodiment of the invention. The computer processor 770 may be energized (itself) in any manner as desired, such as a small battery or in some manner energized by the plug assembly 720.

The device 700 may also be provided with a physical switch 790. The physical switch 790 might work in conjunction with the computer processor 770, or alternatively, be in lieu of the computer processor 770. Illustratively, the physical switch 790 might have 3 settings—to control the manner in which the USB port 742 is powered. A first setting in which power is drawn from the AC source, i.e. the plug assembly 720. A second setting in which power is drawn from the battery. A third setting in which the power may be drawn from either the plug assembly 720 or the battery 780. This determination (of the third setting) is determined in an automated manner by the computer 770. It is appreciated that with the third setting, the computer processor 770 or some other type of microchip may be utilized, i.e. so as to perform the automated switching between power sources. For example, the power may be switched from the plug assembly 722 to the rechargeable battery 780 (or vice-a-verse) upon the computer 770 determining that the AC power has dropped or attained a certain level and/or that the battery power has dropped or attained a certain level for example. Also, and relatedly, the computer processor 770 may switch power sources if the power from the rechargeable battery 780 is disconnected or if the power from the plug assembly 720 is disconnected. It is appreciated that other factors, attributes and parameters might be utilized in the determination (by the computer processor 770) of which power source to use.

Additionally, the device with the computer processor 770 may be provided with additional smart features installed in the device. For example the device may be provided with the ability to turn itself off when not in use, and to provide a night light by utilizing a light sensor, for example. Other smart features may be utilized.

The computer processor 770 may utilize (or be in the form of) any of a wide variety of technologies including a special purpose computer, a computer system including a micro-computer, mini-computer or mainframe for example, a programmed microprocessor, a micro-controller, a peripheral integrated circuit element, a CSIC (Consumer Specific Integrated Circuit) or ASIC (Application Specific Integrated Circuit) or other integrated circuit, a logic circuit, a digital signal processor, a programmable logic device such as a FPGA, PLD, PLA or PAL, or any other device or arrangement of devices that is capable of implementing the processing of the invention.

A set of instructions may be used in the processing of the invention—for example to control the described automation and other operations of the computer. The set of instructions may be in the form of a program or software. The software may be in the form of system software or application software, for example. The software might also be in the form of a collection of separate programs, a program module within a larger program, or a portion of a program module, for example. The software used might also include modular programming in the form of object oriented programming. The software tells the processing machine what to do with the data being processed.

Further, it is appreciated that the instructions or set of instructions used in the implementation and operation of the invention may be in a suitable form such that the processing machine may read the instructions. For example, the instructions that form a program may be in the form of a suitable programming language, which is converted to machine language or object code to allow the computer 770 to read the instructions.

It is appreciated that various receptacles, sockets, and other connection points are described herein as disposed on a particular surface of the device of the invention. However, the invention is not limited to such spatial relationship. Illustratively, such receptacles, sockets and other connection points may be disposed on a curved surface and/or on a side of the device, for example.

It is appreciated that various features described herein as used in conjunction with one embodiment of the invention may be used in other embodiments of the invention, as may be desired.

It is appreciated that the particular size of a device of the invention may vary as desired. Illustratively, a device of the invention may be approximately 4 inches at the bottom of the device and 3.5 inches at the top of the device, and approximately 4 inches tall. However, the particular dimensions utilized may vary depending on a variety of parameters, including the number of receptacles disposed on the front of the device.

It is appreciated that various known components may be utilized in the device of the invention. In particular, known cables, sockets, receptacles, USB (Universal serial bus) ports, wires, circuit breakers, and other known components may be utilized in the invention—which should be appreciated by one of ordinary skill in the art in light of the disclosure set forth herein.

The devices and methods of the invention are described herein relating to various structure of the embodiments and the conveyance of electricity between the various components of embodiments. It is appreciated that such may be utilized hand in hand with data transfer as may be desired. Illustratively, the USB ports utilized in the invention may also be provided with the capability to transfer data using known techniques. That is, in addition to the various wires utilized to provide electrical power to a USB port or other component—the invention may also provide wiring and structure to afford data transfer, as may be desired.

It is appreciated that the upright standing position of the Evolt365 receptacle/USB ports helps to prevent liquids and or other fluids/dust/debris from spilling into the orifice or other openings of receptacle's or USB ports.

The device of the invention, which may be characterized as the "Evolt" or "Evolt 365" provides a simple and very easy approach to power itself, by piggy backing or leeching off the power source of a PC monitor's power source, i.e. a PC monitor's power cord. The device of the invention may vary in size as desired. For example, the device may be of a smaller scale so as to accommodate a single 120 volt outlet and single USB port in the front of the device. On the other hand, the device may be a larger scale to accommodate as many outlets and/or USB ports and/or other type of port as may be desired. The device of the invention is very easy to install. Further, the device of the invention appeals to a wide variety of users in that the color and style design choices are essentially endless. In particular, the color and style designs of the receptacles and the cover plates, for example, may be varied as desired—so as to be appropriate and appealing for a wide variety of users—both in the home and at work. The device of the invention may be used with standardized cables, in accordance with one embodiment of the invention, that can be the user's choice in length and color.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A device for providing electrical power comprising:

a housing portion that includes:

at least one vertical wall, the vertical wall having an upper portion and a lower portion;

a top portion connected to the upper portion of the at least one vertical wall, and the at least one vertical wall and the top portion forming an interior space;

a plug assembly including positive and negative prongs, outwardly facing, for interfacing with a female cord end, the plug assembly disposed in the interior space and supported by the at least one vertical wall at a back of the housing portion;

a first outlet assembly including positive and negative apertures, outwardly facing, for interfacing with a male cord end, the first outlet assembly disposed in the interior space and supported by the at least one vertical wall at the back of the housing portion;

a first wire route, and the negative prong of the plug assembly being in direct connection, via the first wire route, with the negative aperture of the first outlet assembly;

a second wire route, and the positive prong of the plug assembly being in direct connection, via the second wire route, with the positive aperture of the first outlet assembly;

a second outlet assembly including at least one receptacle for interfacing with a male cord end, the second outlet assembly disposed in the interior space and supported by the at least one vertical wall at a front of the housing portion, the second outlet assembly having a negative connection and a positive connection;

a third wire route, and the negative prong of the plug assembly being in connection, via the third wire route, with the negative connection of the second outlet assembly;

a wire assembly, and the positive prong of the plug assembly being in connection, via the wire assembly, with the positive connection of the second outlet assembly; and the wire assembly including a fourth wire route, circuit breaker, and fifth wire route connected in sequence serving to connect the positive prong of the plug assembly with the positive connection of the second outlet assembly.

2. The device of claim 1, the second outlet assembly is a USB receptacle.

3. The device of claim 1, the second outlet assembly is an outlet for alternating current (AC), the AC being main electric power, including:

the negative prong of the plug assembly being in connection, via the third wire route, with a negative aperture of second outlet assembly; and the positive prong of the plug assembly being in connection, via the wire assembly, with a positive aperture of the second outlet assembly.

4. The device of claim 1, further including a third outlet assembly including positive and negative apertures, outwardly facing, for interfacing with a male cord end, the second outlet assembly disposed in the interior space and supported by the at least one vertical wall at the front of the housing portion;

the negative prong of the plug assembly being in connection, via the third wire route, with the negative aperture of the third outlet assembly; and the positive prong of the plug assembly being in connection, via the wire assembly, with the positive aperture of the third outlet assembly.

5. The device of claim 1, the plug assembly with prongs being disposed below the first outlet assembly at the back of the housing portion.

6. The device of claim 5, the second outlet assembly being disposed below a third outlet assembly at the front of the housing portion.

7. The device of claim 1, further including a universal serial bus (USB) outlet, the USB outlet being in electrical connection with the third wire route and the fourth wire route, so as to provide power to the USB outlet.

8. The device of claim 7, further including a second universal serial bus (USB) outlet, the second USB outlet being in electrical connection with the third wire route and the fourth wire route, so as to provide power to the second USB outlet.

9. The device of claim 1, the plug assembly and the first outlet assembly being integrally formed as a unit, and the unit attached to the housing portion.

10. The device of claim 1, the second outlet assembly and a third outlet assembly being integrally formed as a unit, and the unit attached to the housing portion.

11. The device of claim 1, the housing portion being constructed of plastic.

12. The device of claim 1, the at least one vertical wall including a front wall, a left side wall, a back wall and a right side wall connected in sequence.

13. The device of claim 1, the housing portion further including a bottom wall connected to the at least one vertical wall.

14. The device of claim 1, the top portion including a personal device holder.

15. The device of clam 14, the personal device holder constituted by a groove disposed in the top portion.

16. The device of claim 15, the top portion formed of plastic.

17. The device of claim 1, the third wire route including two wires connected via a wire connector.

18. The device of claim 17, the wire connector constituted by a conical threaded wire nut.

19. A device for providing electrical power comprising:

a housing portion that includes:

at least one vertical wall, the vertical wall having an upper portion and a lower portion;

a top portion connected to the upper portion of the at least one vertical wall, and the at least one vertical wall and the top portion forming an interior space;

a plug assembly including positive and negative prongs, outwardly facing, for interfacing with a female cord end, the plug assembly disposed in the interior space and supported by the at least one vertical wall at a back of the housing portion;

a first outlet assembly including positive and negative apertures, outwardly facing, for interfacing with a male cord end, the first outlet assembly disposed in the interior space and supported by the at least one vertical wall at the back of the housing portion;

a first wire route, and the negative prong of the plug assembly being in direct connection, via the first wire route, with the negative aperture of the first outlet assembly;

a second wire route, and the positive prong of the plug assembly being in direct connection, via the second wire route, with the positive aperture of the first outlet assembly;

a second outlet assembly including at least one receptacle for interfacing with a male cord end, the second outlet assembly disposed in the interior space and supported by the at least one vertical wall at a front of the housing portion, the second outlet assembly having a negative connection and a positive connection;

a third wire route, and the positive prong of the plug assembly being in connection, via the third wire route, with the positive connection of the second outlet assembly;

a wire assembly, and the negative prong of the plug assembly being in connection, via the wire assembly, with the negative connection of the second outlet assembly; and the wire assembly including a fourth wire route, circuit breaker, and fifth wire route connected in sequence serving to connect the negative prong of the plug assembly with the negative connection of the second outlet assembly.

20. A method for providing electrical power, the method comprising:

providing a device that includes a housing portion, the housing portion including:

at least one vertical wall, the vertical wall having an upper portion and a lower portion;

a top portion connected to the upper portion of the at least one vertical wall, and the at least one vertical wall and the top portion forming an interior space;

a plug assembly including positive and negative prongs, outwardly facing, for interfacing with a female cord end, the plug assembly disposed in the interior space and supported by the at least one vertical wall at a back of the housing portion;

a first outlet assembly including positive and negative apertures, outwardly facing, for interfacing with a male cord end, the first outlet assembly disposed in the interior space and supported by the at least one vertical wall at the back of the housing portion;

a first wire route, and the negative prong of the plug assembly being in direct connection, via the first wire route, with the negative aperture of the first outlet assembly;

a second wire route, and the positive prong of the plug assembly being in direct connection, via the second wire route, with the positive aperture of the first outlet assembly;

a second outlet assembly including at least one receptacle for interfacing with a male cord end, the second outlet assembly disposed in the interior space and supported by the at least one vertical wall at a front of the housing portion, the second outlet assembly having a negative connection and a positive connection;

a third wire route, and the negative prong of the plug assembly being in connection, via the third wire route, with the negative connection of the second outlet assembly;

a wire assembly, and the positive prong of the plug assembly being in connection, via the wire assembly, with the positive connection of the second outlet assembly; and the wire assembly including a fourth wire route, circuit breaker, and fifth wire route connected in sequence serving to connect the positive prong of the plug assembly with the positive connection of the second outlet assembly; connecting a first cable between the plug assembly and an outlet associated with a building structure;

connecting a second cable between the first outlet assembly and a computer monitor; and plugging a further device into the second outlet assembly so as to provide energy to the further device.

* * * * *